United States Patent [19]

Licari et al.

[11] 4,372,450

[45] Feb. 8, 1983

[54] HANGING RACKS

[75] Inventors: Vito Licari; Yaffa Licari, both of Elberon, N.J.

[73] Assignee: Basic Line, Inc., Cliffwood Beach, N.J.

[21] Appl. No.: 327,806

[22] Filed: Dec. 7, 1981

[51] Int. Cl.[3] ..... A47F 5/08

[52] U.S. Cl. ..... 211/87; 211/32; 248/220.2; 248/304

[58] Field of Search ..... 211/87, 32, 35, 192; 248/304, 307, 220.2, 221.3, 223.1, 222.4, 225.2

[56] References Cited

U.S. PATENT DOCUMENTS

| | | | |
|---|---|---|---|
| 177,471 | 5/1876 | Clark | 248/304 X |
| 327,939 | 10/1885 | Janison | 248/304 X |
| 1,096,660 | 5/1914 | Wood | 248/222.2 |
| 1,491,286 | 4/1924 | Calhoun | 248/316 |
| 1,575,270 | 3/1926 | Jankowsky . | |
| 1,848,937 | 3/1932 | Coventry | 211/87 |
| 1,930,965 | 10/1933 | Christy | 211/94 X |
| 2,239,978 | 4/1941 | Sanford | 248/221.3 |
| 3,504,878 | 4/1970 | Dressler | 211/87 X |
| 3,802,654 | 4/1974 | Jenko et al. | 248/221.3 X |
| 3,954,182 | 5/1976 | McEvers | 211/94 |
| 4,069,920 | 1/1978 | Ross | 211/87 |

FOREIGN PATENT DOCUMENTS

| | | | |
|---|---|---|---|
| 122735 | 5/1931 | Fed. Rep. of Germany | 211/87 |
| 2729 | of 1906 | United Kingdom | 248/222.4 |
| 1123315 | 8/1968 | United Kingdom | 211/192 |

*Primary Examiner*—Francis K. Zugel
*Assistant Examiner*—Robert W. Gibson, Jr.
*Attorney, Agent, or Firm*—Lerner, David, Littenberg & Samuel

[57] ABSTRACT

A hanging rack includes a support member and at least one hanger which is removably attached to the support member. The support member is provided with an internal receptacle having a receiving station adapted to releasably receive a plug attached to the hanger. The receptacle also includes a locking station which communicates with the receiving station such that the plug can be moved from the receiving station to the locking station, where it is releasably locked in place.

64 Claims, 3 Drawing Figures

HANGING RACKS

FIELD OF THE INVENTION

The present invention relates to hanging racks, and, more particularly, to such racks which are especially adapted to hang articles of clothing, such as coats and hats, therefrom. As used herein, the term "hanging racks" defines racks which can be hung from a wall or some other vertical support surface, such as a door.

BACKGROUND OF THE INVENTION

Hanging racks have been developed which employ removeable and interchangeable hangers (see, for example, U.S. Pat. Nos. 1,848,937 and 4,069,920). The techniques employed to attach the hangers to these racks have created a variety of problems.

In U.S. Pat. No. 1,848,937, for instance, there is disclosed a rack including a metallic strip having pairs of spring tongues which are spaced apart along the length of the strip. Each pair of spring tongues receives a hook member from which clothes, such as coats and hats, may be hung. The rack suffers from two disadvantages as a result of the design and construction of the spring tongues. First, the strip is basically limited to a metallic construction, because the forces applied to the tongues by the clothes hung from the hook members would bend or break the tongues if they were made from many non-metallic materials, such as plastic. Second, because the tongues extend outwardly from the strip, they detract from the aesthetic appearance of the rack.

A wall bracket system is disclosed in U.S. Pat. No. 4,069,920. The wall bracket system includes a plurality of nestable rings. Each ring is provided with a plurality of holes adapted to receive hooks for holding articles such as towels, ties, scarves, etc. Each hook has a shank portion which terminates in a pair of resilient prongs adapted to be snapped together for insertion through one of the holes and released for clamping engagement with one of the rings. The wall bracket system suffers from two disadvantages. First, because the resilient prongs must be bent in order to insert and remove the hooks, the prongs can be permanently deformed or broken as a result of repeated bending, thereby impairing or destroying their clamping ability. Second, because the prongs extend outwardly beyond the back of the rings, the rings cannot be mounted flush against a wall or similar mounting surface.

SUMMARY OF THE INVENTION

The problems and disadvantages of the prior art racks described above are overcome by the present invention which involves a new and improved hanging rack including a support member and at least one hanger. In order to removeably attach the hanger or hangers to the support member, a corresponding number of receptacles is provided in the support member. Each receptacle has a receiving station sized and shaped so as to releaseably receive a plug of a corresponding hanger when the plug is inserted into the receptacle from the front of the support member towards the back thereof. Each of the receptacles also includes a locking station which communicates with the receiving station. The locking station is sized and shaped so as to releaseably lock the plug in the receptacle when the plug is moved from the receiving station to the locking station. Because the receptacle or receptacles are provided internally of the support member, the front and back of the support member can be relatively flat, thereby facilitating its flush attachment to a wall or similar mounting surface while preserving the aesthetic appearance of the rack. Despite its flat construction, the front of the support member may cooperate in mechanically locking each plug in the locking station of its corresponding receptacle.

Each hanger can be designed such that it covers a corresponding one of the receptacles, whereby the receptacles are completely hidden from view so as to further enhance the aesthetic appearance of the rack. Each hanger can also be designed so as to inhibit its inadvertent detachment from the support member.

In one embodiment, the support member includes a substantially open framework and a rib or ribs extending between opposite ends of the framework. Each rib contains one of the receptacles used for attaching the hanger or hangers to the support member. If the support member is made from plastic, the rib or ribs can be formed monolithically with the framework to eliminate any fasteners otherwise required in the manufacture of the support member. Likewise, each hanger can be formed monolithically to further reduce the number of parts required to make the rack.

BRIEF DESCRIPTION OF THE DRAWINGS

For a more complete understanding of the present invention, reference may be had to the following description of an exemplary embodiment taken in conjunction with the accompanying figures of the drawings, in which.

DESCRIPTION OF THE EXEMPLARY EMBODIMENT

Figure 1:
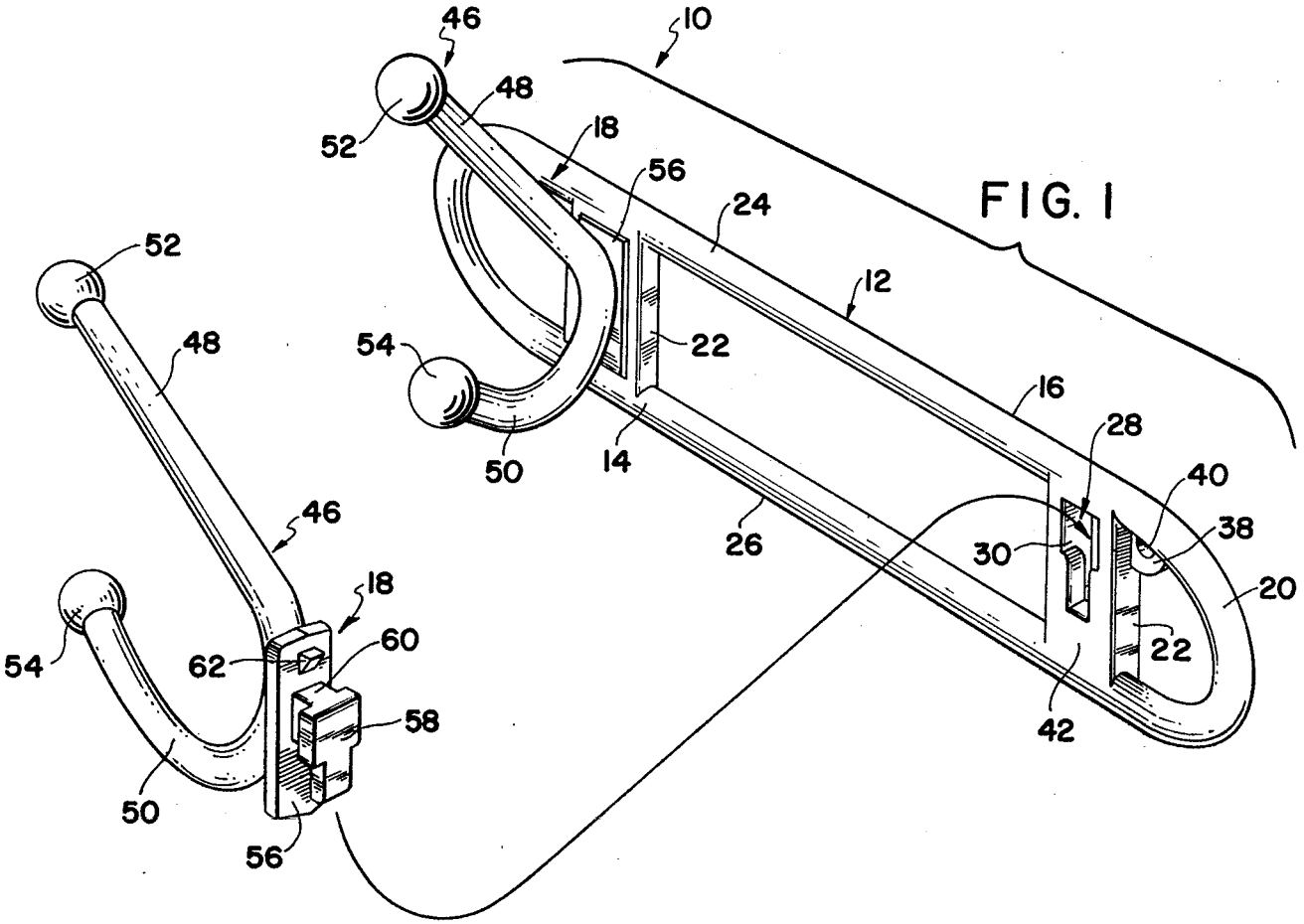
FIG. 1 is an exploded perspective view of a hanging rack constructed in accordance with the present invention.
Figure 2:
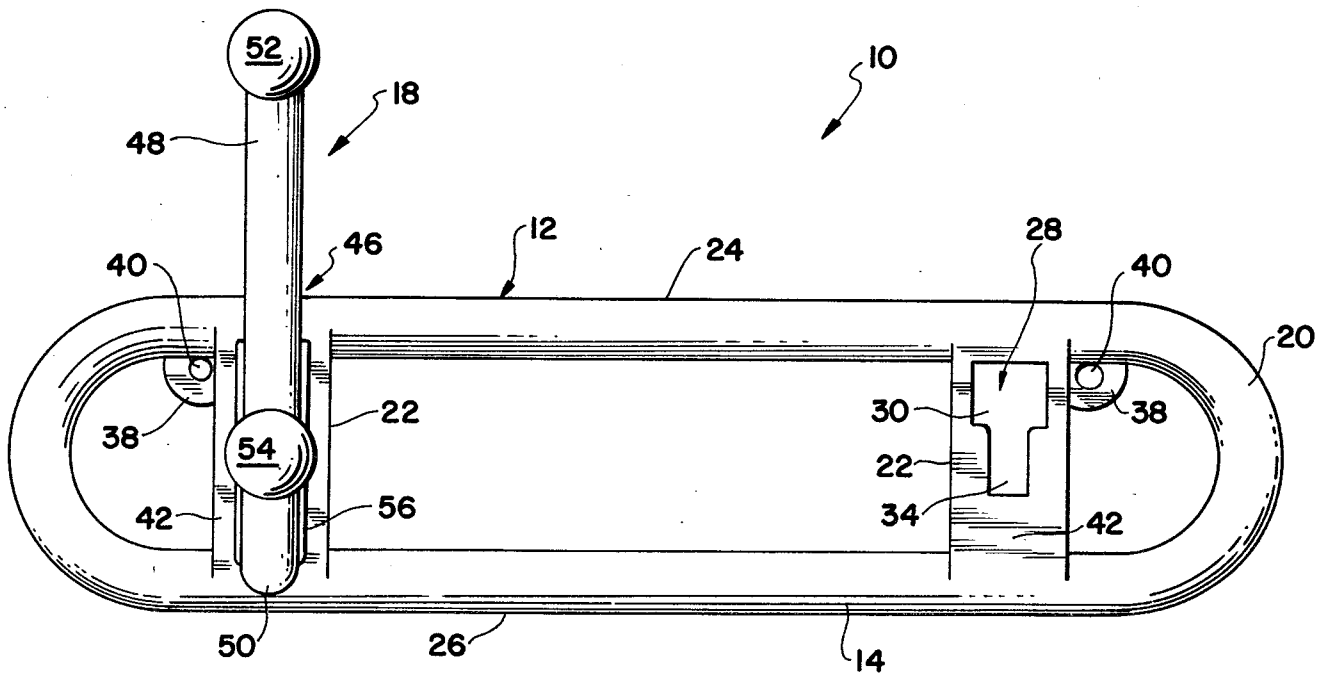
FIG. 2 is a front view of the rack illustrated in FIG. 1, one hook being removed to facilitate consideration and discussion.
Figure 3:
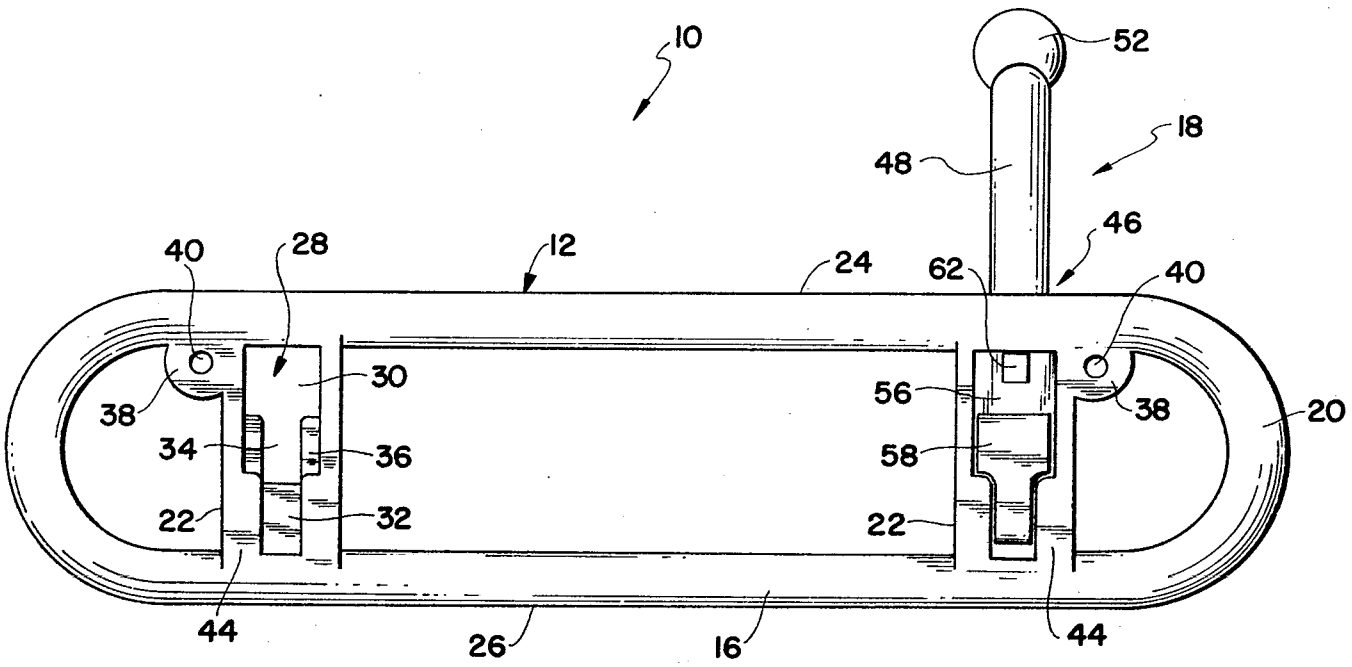
FIG. 3 is a back view of the rack illustrated in FIG. 2.

Referring to FIGS. 1–3 of the drawings, there is shown a hanging rack 10 which includes a support member 12, having a front 14 and a back 16, and a pair of hangers 18 extending outwardly from the front 14 of the support member 12. The support member 12 includes a substantially open elongated framework 20 and a pair of vertical ribs 22 extending between an upper end 24 and a lower end 26 of the framework 20. Each of the ribs 22 is provided with an opening 28 which forms a receptacle for a corresponding one of hangers 18. More particularly, each of the openings 28 includes a generally T-shaped receiving station 30 and generally T-shaped locking station 32 (see FIG. 3). A lower portion 34 of the T-shaped receiving station 30 forms a part of an upper portion 36 of the T-shaped locking station 32 (see FIG. 3). A pair of mounting ears 38 are also provided on the framework 20. Each of the ears 38 is positioned alongside one of the ribs 22 and is provided with a hole 40 for receiving a fastener, such as a screw, so that the support member 12 may be attached to a vertical support surface, such as a door or a wall. The support member 12 is molded monolithically from a plastic material such that the framework 20, the ribs 22 and the mounting ears 38 are formed as a single piece. The ribs 22 have front and back faces 42, 44, respectively, which are substantially flush with the front 14 and the back 16, respectively, of the support member 12.

Each of the hangers 18 includes a generally U-shaped hook 46 having a pair of substantially parallel legs 48, 50, the upper leg 48 being longer than the lower leg 50. Both of the legs 48, 50 extend upwardly at an inclined angle relative to the support member 12. Each of the legs 48, 50 is provided with a ball-shaped tip 52, 54, respectively, which facilitates the hanging of articles from the hangers 12. Each of the hangers 18 also includes an apron 56 having a generally rectangular shape. The size and shape of the aprons 56 are selected such that the aprons 56 will cover the openings 28 formed in the ribs 22 of the support member 12, whereby the openings 28 will be hidden from view from the front 14 of the support member 12. Each of the aprons 56 has a T-shaped plug 58 and a neck 60 which attaches the plug 58 to the apron 56 such that the plug 58 extends outwardly from the apron 56 in a direction opposite to that of the hook 46. The size and shape of the plugs 58 and the necks 60 are selected such that they are compatible with the openings 28 formed in the ribs 22 of the support member 12. More particularly, the size and shape of the plugs 58 are such that the plugs 58 can be snapped into the receiving stations 30 of the openings 28 and then slid into the locking stations 32. Each of the aprons 56 also includes a locking wedge 62 which is positioned just above the plug 58. The hangers 18, like the support member 12, can be molded monolithically from a plastic material.

The rack 10 is designed such that the hangers 18 may be fastened to the support member 12 at the factory or the hangers 18 and the support member 12 may be shipped individually and then subsequently assembled by a purchaser.

In order to assemble the rack 10, the plugs 58 of the hangers 18 are snapped into the receiving stations 30 of the openings 28. The plugs 58 are then slid downward into the locking stations 32 of the openings 28, where they are mechanically locked in position. More particularly, when the plugs 58 are positioned in the locking stations 32, the front faces 42 of the ribs 22 prevent the hangers 18 from inadvertently falling out of the openings 28 while the locking wedges 62 prevent the inadvertent upward movement of the hangers 18 when articles are being removed therefrom. Furthermore, when the hangers 18 are locked in place in the openings 28, the plugs 58 are positioned entirely within the ribs 22 so that the plugs 58 do not extend beyond the back face 44 of the ribs 22, thereby allowing the rack 10 to be mounted flush against a wall or door. Also, when the hangers 18 are locked in place in the openings 28, the aprons 56 completely cover the openings 28, thereby enhancing the aesthetic appearance of the rack 10.

It will be understood that the embodiment described herein is merely exemplary and that a person skilled in the art may make many variations and modifications without departing from the spirit and scope of the invention. For instance, the number of hangers may be varied as desired. Thus, the rack may be provided with a single hanger or with three or more hangers. All such modifications and variations are intended to be included within the scope of the invention as defined in the appended claims.

I claim:

1. A plastic hanging rack, comprising:

plastic hanging means for hanging articles therefrom, said hanging means including a plug, and a plastic support member, having a front, a back and a receptacle provided internally of said support member, said receptacle having a receiving station sized and shaped so as to form a snap fit with said plug of said hanging means and to releaseably receive said plug of said hanging means when said plug is snapped into said receptacle from said front of said support member towards said back of said support member and a locking station communicating with said receiving station, said locking station being sized and shpaed so as to releaseably lock said plug of said hanging means in said receptacle when said plug is moved from said receiving station to said locking station.

2. A rack according to claim 1, wherein said locking station is located directly below said receiving station.

3. A rack according to claim 2, wherein said receptacle is sized and shaped such that said plug may be slid downwardly from said receiving station to said locking station and upwardly from said locking station to said receiving station.

4. A rack according to claim 2, wherein said plug is sized and shaped so as to be completely received within said receptacle when said hanging means is attached to said support member.

5. A rack according to claim 4, wherein said plug and said locking station are generally T-shaped.

6. A rack according to claim 5, wherein said receiving station is generally T-shaped, a lower portion of said T-shaped receiving station forming a part of an upper portion of said T-shaped locking station.

7. A rack according to claim 6, wherein said T-shaped receiving station is formed in said front of said support member.

8. A rack according to claim 7, wherein only said T-shaped receiving station of said receptacle is visible from said front of said support member when said hanging means is detached from said support member.

9. A rack according to claim 8, wherein said hanging means includes covering means for covering said T-shaped receiving station when said plug is releaseably locked in said T-shaped locking station, whereby said receptacle is completely hidden from view from said front of said support member when said plug is releaseably locked in said T-shaped locking station.

10. A rack according to claim 9, wherein said front and back of said support member are substantially flat.

11. A rack according to claim 10, wherein said receptacle is an opening extending from said back of said support member to said front of said support member.

12. A rack according to claim 11, wherein said front of said support member cooperates in mechanically locking said T-shaped plug in said T-shaped locking station of said receptacle.

13. A rack according to claim 1, wherein said hanging means includes a plurality of hooks, each hook having a plug, and said support member includes a plurality of receptacles provided internally of said support member, each of said receptacles having a receiving station sized and shaped so as to form a snap fit with a plug of a corresponding one of said hooks and to releaseably receive said plug of said corresponding hook when said plug is snapped into said receptacle from said front of said support member towards said back of said support member and a locking station communicating with said receiving station, said locking station being sized and shaped so as to releaseably lock said plug in said receptacle when said plug is moved from said receiving station to said locking station.

14. A rack according to claim 1, wherein said support member includes mounting means for mounting said support member on a wall.

15. A rack according to claim 1, wherein said hanging means includes inhibiting means for inhibiting the inadvertent movement of said plug from said locking station to said receiving station.

16. A rack according to claim 15, wherein said inhibiting means includes a wedge which engages an edge of said receptacle.

17. A rack according to claim 1, wherein said support member includes a substantially open framework and a rib extending between opposite ends of said framework, said receptacle being formed in said rib.

18. A hanging rack, comprising:

hanging means for hanging articles therefrom, said hanging means including a T-shaped plug, and a support member, having a front, a back and a receptacle provided internally of said support member, said receptacle having a T-shaped receiving station sized and shaped so as to releaseably and completely receive said plug of said hanging means when said plug is inserted into said receptacle from said front of said support member towards said back of said support member and a T-shaped locking station located directly below said receiving station and communicating with said receiving station such that a lower portion of said receiving station forms a part of an upper portion of said locking station, said locking station being sized and shaped so as to releaseably lock said plug of said hanging means in said receptacle when said plug is moved from said receiving station to said locking station.

19. A rack according to claim 18, wherein said receptacle is sized and shaped such that said plug may be slid downwardly from said receiving station to said locking station and upwardly from said locking station to said receiving station.

20. A rack according to claim 18, wherein said receiving station is formed in said front of said support member.

21. A rack according to claim 20, wherein only said receiving station of said receptacle is visible from said front of said support member when said hanging means is detached from said support member.

22. A rack according to claim 21, wherein said hanging means includes covering means for covering said receiving station when said plug is releaseably locked in said locking station, whereby said receptacle is completely hidden from view from said front of said support member when said plug is releasably locked in said locking station.

23. A rack according to claim 22, wherein said front and back of said support member are substantially flat.

24. A rack according to claim 23, wherein said receptacle is an opening extending from said back of said support member to said front of said support member.

25. A rack according to claim 24, wherein said plug is sized and shaped so as to be snapped into said receiving station of said opening.

26. A rack according to claim 25, wherein said front of said support member cooperates in mechanically locking said plug in said locking station of said receptacle.

27. A rack according to claim 18, wherein said hanging means includes a plurality of hooks, each hook having a T-shaped plug, and said support member includes a plurality of receptacles provided internally of said support member, each of said receptacles having a T-shaped receiving station sized and shaped so as to releaseably and completely receive a plug of a corresponding one of said hooks when said plug is inserted into said receptacle from said front of said support member towards said back of said support member and a T-shaped locking station located directly below said receiving station and communicating with said receiving station such that a lower portion of said receiving station forms a part of an upper portion of said locking station, said locking station being sized and shaped so as to releaseably lock said plug in said receptacle when said plug is moved from said receiving station to said locking station.

28. A rack according to claim 18, wherein said support member includes mounting means for mounting said support member on a wall.

29. A rack according to claim 18, wherein said hanging means includes inhibiting means for inhibiting the inadvertent movement of said plug from said locking station to said receiving station.

30. A rack according to claim 29, wherein said inhibiting means includes a wedge which engages an edge of said receptacle.

31. A rack according to claim 18, wherein said support member includes a substantially open framework and a rib extending between opposite ends of said framework, said receptacle being formed in said rib.

32. A rack according to claim 31, wherein said support member is made from plastic, said rib being formed monolithically with said framework.

33. A rack according to claim 32, wherein said hanging means is made from plastic.

34. A hanging rack, comprising:

hanging means for hanging articles therefrom, said hanging means including a plug, a support member, having a front, a back and a receptacle provided internally of said support member, said receptacle having a receiving station sized and shaped so as to releaseably receive said plug of said hanging means when said plug is inserted into said receptacle from said front of said support member towards said back of said support member and a locking station communicating with said receiving station, said locking station being sized and shaped so as to releaseably lock said plug of said hanging means in said receptacle when said plug is moved from said receiving station to said locking station, and inhibiting means for inhibiting the inadvertent movement of said plug from said locking station to said receiving station, said inhibiting means including a wedge positioned on said hanging means so as to engage an edge of said receptacle.

35. A rack according to claim 34, wherein said locking station is located directly below said receiving station.

36. A rack according to claim 35, wherein said receptacle is sized and shaped such that said plug may be slid downwardly from said receiving station to said locking station and upwardly from said locking station to said receiving station.

37. A rack according to claim 35, wherein said plug is sized and shaped so as to be completely received within said receptacle when said hanging means is attached to said support member.

38. A rack according to claim 37, wherein said receiving station is formed in said front of said support member.

39. A rack according to claim 38, wherein only said receiving station of said receptacle is visible from said front of said support member when said hanging means is detached from said support member.

40. A rack according to claim 39, wherein said hanging means includes covering means for covering said receiving station when said plug is releaseably locked in said locking station, whereby said receptacle is completely hidden from view from said front of said support member when said plug is releaseably locked in said locking station.

41. A rack according to claim 40, wherein said front and back of said support member are substantially flat.

42. A rack according to claim 41, wherein said receptacle is an opening extending from said back of said support member to said front of said support member.

43. A rack according to claim 42, wherein said plug is sized and shaped so as to be snapped into said receiving station of said opening.

44. A rack according to claim 43, wherein said front of said support member cooperates in mechanically locking said plug in said locking station of said receptacle.

45. A rack according to claim 34, wherein said hanging means includes a plurality of hooks, each hook having a plug, said support member includes a plurality of receptacles provided internally of said support member, each of said receptacles having a receiving station sized and shaped so as to releaseably receive a plug of a corresponding one of said hooks when said plug is inserted into said receptacle from said front of said support member towards said back of said support member and a locking station communicating with said receiving station, said locking station being sized and shaped so as to releaseably lock said plug in said receptacle when said plug is moved from said receiving station to said locking station, and said inhibiting means includes a plurality of wedges, each wedge being positioned on a corresponding one of said plugs so as to engage an edge of an associated one of said receptacles.

46. A rack according to claim 34, wherein said support member includes mounting means for mounting said support member on a wall.

47. A rack according to claim 34, wherein said support member inludes a substantially open framework and a rib extending between opposite ends of said framework, said receptacle being formed in said rib.

48. A rack according to claim 47, wherein said support member is made from plastic, said rib being formed monolithically with said framework.

49. A rack according to claim 48, wherein said hanging means is made from plastic.

50. A hanging rack, comprising:

hanging means for hanging articles therefrom, said hanging means including a plug, and a support member in the form of a substantially open framework, said support member including a front, a back, a rib extending between opposite ends of said framework and a receptacle provided in said rib internally of said support member, said receptacle having a receiving station sized and shaped so as to releaseably receive said plug of said hanging means when said plug is inserted into said receptacle from said front of said support member towards said back of said support member and a locking station communicating with said receiving station, said locking station being sized and shaped so as to releaseably lock said plug of said hanging means in said receptacle when said plug is moved from said receiving station to said locking station.

51. A rack according to claim 50, wherein said locking station is located directly below said receiving station.

52. A rack according to claim 51, wherein said receptacle is sized and shaped such that said plug may be slid downwardly from said receiving station to said locking station and upwardly from said locking station to said receiving station.

53. A rack according to claim 51, wherein said plug is sized and shaped so as to be completely received within said receptacle when said hanging means is attached to said support member.

54. A rack according to claim 53, wherein said receiving station is formed in said front of said support member.

55. A rack according to claim 54, wherein only said receiving station of said receptacle is visible from said front of said support member when said hanging means is detached from said support member.

56. A rack according to claim 55, wherein said hanging means includes covering means for covering said receiving station when said plug is releaseably locked in said locking station, whereby said receptacle is completely hidden from view from said front of said support member when said plug is releaseably locked in said locking station.

57. A rack according to claim 56, wherein said support member is made from plastic, said rib being formed monolithically with said framework.

58. A rack according to claim 57, wherein said hanging means is made from plastic.

59. A rack according to claim 56, wherein said front and back of said support member are substantially flat.

60. A rack according to claim 59, wherein said receptacle is an opening extending from said back of said support member to said front of said support member.

61. A rack according to claim 60, wherein said plug is sized and shaped so as to be snapped into said receiving station of said opening.

62. A racking according to claim 61, wherein said front of said support member cooperates in mechanically locking said plug in said locking station of said receptacle.

63. A rack according to claim 50, wherein said hanging means includes a plurality of hooks, each hook having a plug, and said support member includes a plurality of ribs extending between opposite ends of said framework and a plurality of receptacles provided internally of said support member, each of said receptacles being located in a corresponding one of said ribs and having a receiving station sized and shaped so as to releaseably receive a plug of a corresponding one of said hooks when said plug is inserted into said receptacle from said front of said support member towards said back of said support member and a locking station communicating with said receiving station, said locking station being sized and shaped so as to releaseably lock said plug in said receptacle when said plug is moved from said receiving station to said locking station.

64. A rack according to claim 50, wherein said support member includes mounting means for mounting said support member on a wall.

* * * * *